United States Patent [19]

Carlsson et al.

[11] 4,022,127

[45] May 10, 1977

[54] SELF-INKING HAND STAMP

[76] Inventors: Per-Arne Carlsson; Bengt Darhult, both of Elinsdalsgatan 8, 502 56 Boras, Sweden

[22] Filed: Mar. 26, 1976

[21] Appl. No.: 670,592

[30] Foreign Application Priority Data

Apr. 30, 1975 Sweden ..... 7505098

[52] U.S. Cl. ..... 101/327

[51] Int. Cl.[2] ..... B41F 1/38

[58] Field of Search ..... 101/327, 333, 368, 103, 101/109, 125, 405

[56] References Cited

UNITED STATES PATENTS

| | | | |
|---|---|---|---|
| 1,353,994 | 9/1920 | Folger | 101/327 |
| 2,839,994 | 6/1958 | Haag | 101/109 |
| 2,900,902 | 8/1959 | Becker | 101/327 |

*Primary Examiner*—Edgar S. Burr
*Assistant Examiner*—A. Heinz
*Attorney, Agent, or Firm*—Sughrue, Rothwell, Mion, Zinn & Macpeak

[57] ABSTRACT

A self-inking hand stamp of the type in which stamping is carried out by depressing a handle against the action of a spring for making a surface provided with symbols (letters, figures, etc) engage a substrate for printing said symbols thereon. An adjutable stop is engaged by a member in the handle, thereby determining the relative positions of the substrate and the symbol surface, respectively. Said stop comprises a two-part bushing of variable length.

4 Claims, 3 Drawing Figures

SELF-INKING HAND STAMP

BACKGROUND OF THE INVENTION

1. Field of the Invention

This invention refers to a self-inking hand stamp of the type having a handle, a base, an intermediate portion comprising an elongate, longitudinally displaceable shaft interconnecting said handle and said base, a self-inking block located in a socket in said base and being provided with symbols on one side for delivering a print of said symbols to a member adapted to receive said print, a spring in said handle for retaining said socket and said block retracted in said base, and hub means in said handle for engaging a stop means for restricting the displacement stroke of said shaft and of said base. 2. Description of the Prior Art In utilizing hand stamps of this type it is of particular importance that the text-supporting porous stamping block does not become compressed to an extent which is too great or too small. If the compression is too great, an unnecessarily large amount of stamping ink will be expelled from the stamping block, whereby the stamping ink is rapidly consumed, and furthermore the print becomes unnecessarily thick and therefore less attractive. Contrary to this, if the compression is not great enough, too small an amount of stamping ink is expelled, whereby the print becomes thin and less legible. Moreover, the stamping block successively becomes thinner as the stamping ink in it is consumed, which in turn means that the pressure becomes lower and lower in spite of the stamping block still containing a sufficient amount of stamping ink for it to be capable of delivering a print having an appearance of a quality that is acceptable.

SUMMARY OF THE INVENTION

In accordance with the present invention, the above-indicated drawbacks are substantially eliminated by the above-mentioned stop means being a two-part bushing of variable length disposed between the handle and the base and surrounding said shaft.

BRIEF DESCRIPTION OF THE DRAWING

An embodiment of the invention will be described more specifically below with reference to the accompanying drawing, in which.

DESCRIPTION OF THE PREFERRED EMBODIMENT

Figure 1:
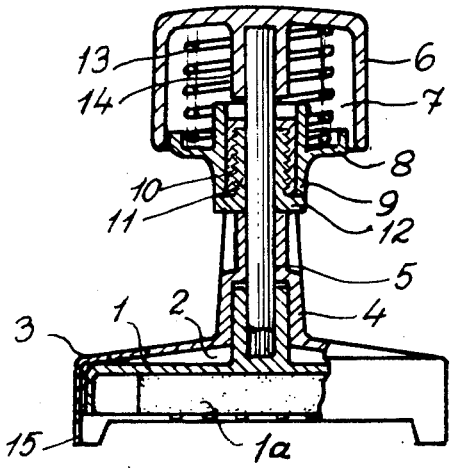
FIG. 1 shows the hand stamp of the invention in a longitudinal view, partly in cross-section.
Figure 2:
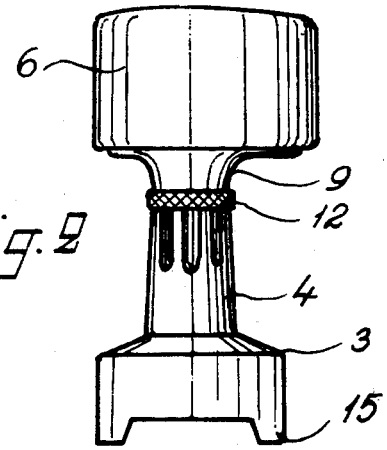
FIG. 2 shows a lateral view of the hand stamp.
Figure 3:
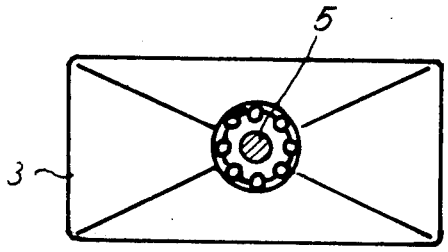
FIG. 3 shows an end view of the hand stamp, including a sectional view through the handle immediately below the above-mentioned bushing.

The hand stamp shown in the drawing is provided with a socket 1 for a symbol-carrying porous stamping block 1*a*. The mentioned symbols may be letters or figures or any other desired symbols. The socket 1 is disposed in a recess 2 in a base 3, said recess being open downwardly. The upper side of this base is provided with a neck 4. The socket 1 is detachably mounted to the lower end of a central shaft or rod 5. This end may appropriately be chamfered so as to prevent components 1 and 5 from rotating with respect to each other and so as to secure these components to each other. The rod 5 is displaceably mounted in the upper end of the neck 4 of the base with its upper end secured to a handle 6 which is provided with a downwardly open recess 7, said handle being closed by means of a disc 8 which is unrotatably disposed in the handle. Said disc has a hub 9, in which two sheaths, namely on outer sheath 10 and an inner sheath 11, forming a bushing are slidingly engaged. The outer sheath 10 is axially displaceable but not rotatable in the hub 9, and it is connected to the inner sheath 11 by means of a threading, said inner sheath being provided with a flange 12, which appropriately may be knurled externally and by means of which the inner sheath may be rotated. As the result of a spring 13 being compressed between the handle 6 and the disc 8, the flange 12 is axially secured between the hub 9 and the upper end of the neck 4. The upper end of the outer sheath 10 forms a stop for a hub 14 which interconnects the handle 6 and the shaft or rod 5, thereby determining the lower extreme position of the socket 1. By rotating the inner sheath 11 by means of the flange 12 it becomes possible to displace the outer sheath 10 and thereby also said stop axially so that the socket 1 will assume its desired lower position so as to control the compression of the stamping block when stamping is carried out.

The base portion 3 is provided with stationary feet 15 which determine the position of the substrate on which stamping is to be effected. Obviously the upper end of sheath 10 should be adjusted in such manner by rotating sheath 11 by means of flange 12 that the printing surface of the stamping block 1*a* is located in the same plane as the lower ends of the feet 15 in stamping so that the stamping block will be compressed to an appropriate extent.

We claim:

1. In a self-inking stamp, having a handle, a base, a socket movably mounted in a recess in said base, a self-inking block located in said socket and being provided with symbols on one side for delivering a print of said symbols to a member adapted to receive said print, spring means an elongated shaft displaceably mounted in said base for interconnecting said handle and said socket for common reciprocal movement relative to said base in said handle for biasing said socket to a retracted position in said recess and a hub carried in said handle for engaging a stop means for adjustably restricting the longitudinal displacement of said shaft and said socket, said stop means having a two-part bushing of variable length disposed between the handle and the base and surrounding said shaft and wherein the parts more relative to each other to vary the length of the bushing.

2. A hand stamp in accordance with claim 1, wherein said two-part bushing comprises two coaxial sheaths engaging each other and being axially displaceable relative to each other, one of said sheaths being unrotatably and axially displaceable relative to the handle, a flange disposed on the other sheath to axially secure said other sheath between the base and the handle, said flange being rotatable and said spring means being a spring clamped between said flange and said handle.

3. A hand stamp in accordance with claim 2, wherein said handle is detachably connected to said socket by means of said shaft, said shaft extending centrally through the bushing and the base.

4. A hand stamp in accordance with claim 3, wherein said spring comprises a helical spring concentric to the bushing and located outside the bushing.

* * * * *

UNITED STATES PATENT AND TRADEMARK OFFICE

CERTIFICATE OF CORRECTION

PATENT NO. : 4,022,127

DATED : May 10, 1977

INVENTOR(S) : Per-Arne Carlsson; Bengt Darhult

It is certified that error appears in the above-identified patent and that said Letters Patent are hereby corrected as shown below:

IN THE CLAIMS:

Column 2, line 40, delete "spring means";

Line 43, after "base" insert --, spring means --;

Line 52, change "more" to -- move --.

Signed and Sealed this

*Eighteenth* Day of *October 1983*

[SEAL]

*Attest:*

GERALD J. MOSSINGHOFF

*Attesting Officer*

*Commissioner of Patents and Trademarks*